United States Patent [19]

O'Mara

[11] Patent Number: 4,736,853

[45] Date of Patent: Apr. 12, 1988

[54] PEN AND PENCIL ACCESSORY HOLDER

[76] Inventor: Kevin O'Mara, 309 Sumner, Topeka, Kans. 66616

[21] Appl. No.: 5,124

[22] Filed: Jan. 20, 1987

[51] Int. Cl.[4] ..... A47F 5/08

[52] U.S. Cl. ..... 211/88; 211/13; 211/69.1; 211/DIG. 1; 248/206.5; 335/285

[58] Field of Search ..... 211/13, 50, 88, 69.1, 211/DIG. 1; 335/285, 296; 248/206.5, 95

[56] References Cited

U.S. PATENT DOCUMENTS 3,237,327 3/1966 Griggs ..... 211/DIG. 1

*Primary Examiner*—Robert W. Gibson, Jr.

*Attorney, Agent, or Firm*—Hovey, Williams, Timmons, & Collins

[57] ABSTRACT

A flexible magnetized holder with pockets for accessories such as pens, tissues, or the like is provided which allows for convenient placement on and removal from ferromagnetic surfaces such as locker doors and refrigerator doors. The holder preferably includes a flexible fabric material, a flexible sheet of non-ferrous material having permanently magnetized particles dispersed throughout the sheet, and means mounting the fabric material to the magnetic sheet for forming a pocket therebetween.

5 Claims, 1 Drawing Sheet

PEN AND PENCIL ACCESSORY HOLDER

BACKGROUND OF THE INVENTION

1. Field of the Invention

This invention relates to a magnetized holder with pockets for accessories such as pens, tissues, or the like of simple yet highly effective construction which has numerous advantages including convenient placement on and removal from a ferromagnetic surface. More particularly, it is concerned with a holder including a flexible sheet of non-ferrous material having permanently magnetized particles dispersed throughout the sheet and a flexible fabric material affixed to the sheet in order to form at least one pocket affixed to the sheet.

2. Description of the Prior Art

Known prior art devices illustrate attempts to provide convenient accessory holders for attachment to vertical surfaces for holding pens, pencils, note pads, tissues, or the like. For example, U.S. Pat. No. 3,187,903 discloses a holder construction having a flexible material formed into pockets which can be attached to a vertical surface by means of pressure sensitive adhesive areas. Such a device, however, is not intended for easy removal and relocation in that the adhesive areas typically do not retain their adhesive properties when relocated.

Other types of accessory holders, such as U.S. Pat. No. 2,943,246, use a permanent magnet to retain accessory holders or the like to a ferromagnetic surface. A permanent magnet holder is removable and relocatable, but has the disadvantage of high cost in order to provide a magnet of sufficient strength to securely hold the accessory holder to a ferromagnetic surface. Additionally, the thickness of a permanent magnet prevents close, flush-mounting of the accessory holder to a vertical surface. Finally, a permanent magnet is not flexible, does not have magnetic properties distributed over a large surface area, and does not conform to surface irregularities.

SUMMARY OF THE INVENTION

The problems outlined above are solved by the accessory holder in accordance with the present invention. That is to say, the accessory holder hereof provides for convenient placement on and removal from a ferromagnetic surface and preferably flexibly conforms to gradual surface irregularities over a relatively large surface area.

The necessary holder in accordance with the present invention broadly includes a flexible fabric material presenting an inner face and an outer face, a sheet of magnetic material presenting a pair of opposed surfaces for releasably and magnetically coupling one surface of said sheet to a ferromagnetic surface, and means mounting the inner face of the fabric material to the other surface of the sheet for defining an accessory-receiving pocket between the inner face and the other surface.

More particularly, the accessory holder includes a flexible sheet of non-ferrous material having permanently magnetized particles dispersed throughout the sheet and the area presented by the other surface in at least half as large as the area presented by the inner face of the fabric material.

In particularly preferred forms, the non-ferrous material includes rubber, the fabric material includes vinyl, and the mounting means includes a pair of spaced-apart gussets sewn to the fabric material and the sheet. Even more particularly, the fabric material is configured to include a pocket flap releasably enclosing the pocket.

DESCRIPTION OF THE PREFERRED EMBODIMENT

Figure 1:
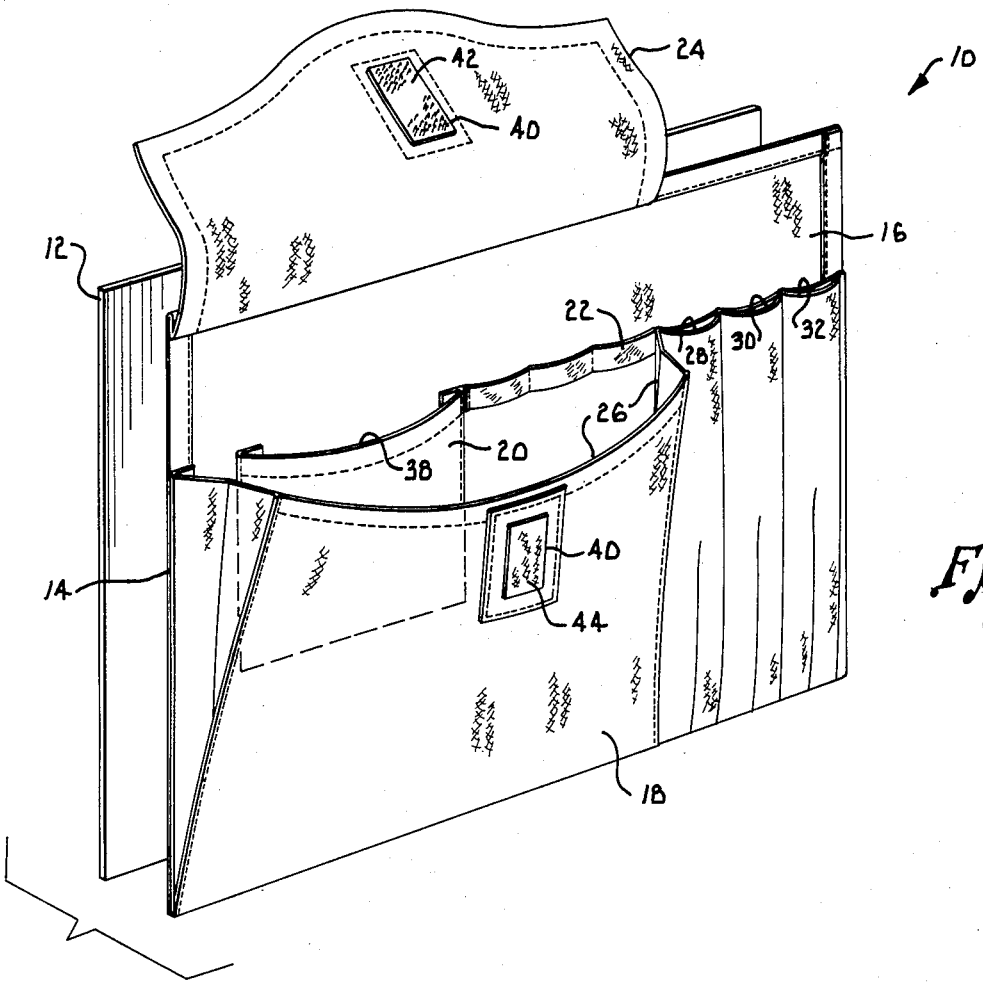
FIG. 1 is an exploded perspective view showing the fabric material separated from the flexible magnetic sheet.

Referring now to the drawings, an accessory holder 10 in accordance with the invention broadly includes flexible magnetic sheet 12 and fabric material 14.

Flexible magnetic sheet 12 is preferably rubber impregnated with permanently magnetized particles distributed throughout so that the entire surface area of the sheet exhibits magnetic properties. The preferred magnetic sheeting material is commercially available under the trade name ULTRA/MAG available from Magnets, Inc. of Cincinnati, Ohio. Magnetic sheeting is available in standard thicknesses of 0.20 or 0.30 inches.

Fabric material 14 is preferably conventionally available vinyl. In the preferred embodiment, fabric material 14 is configured and sewn to sheet 12 in order to present a series of pockets for holding various accessory articles. Specifically, fabric material 14 is configured to include back wall 16, exterior front wall 18, interior front wall 20, elastic band 22, and pocket flap 24.

Figure 2:
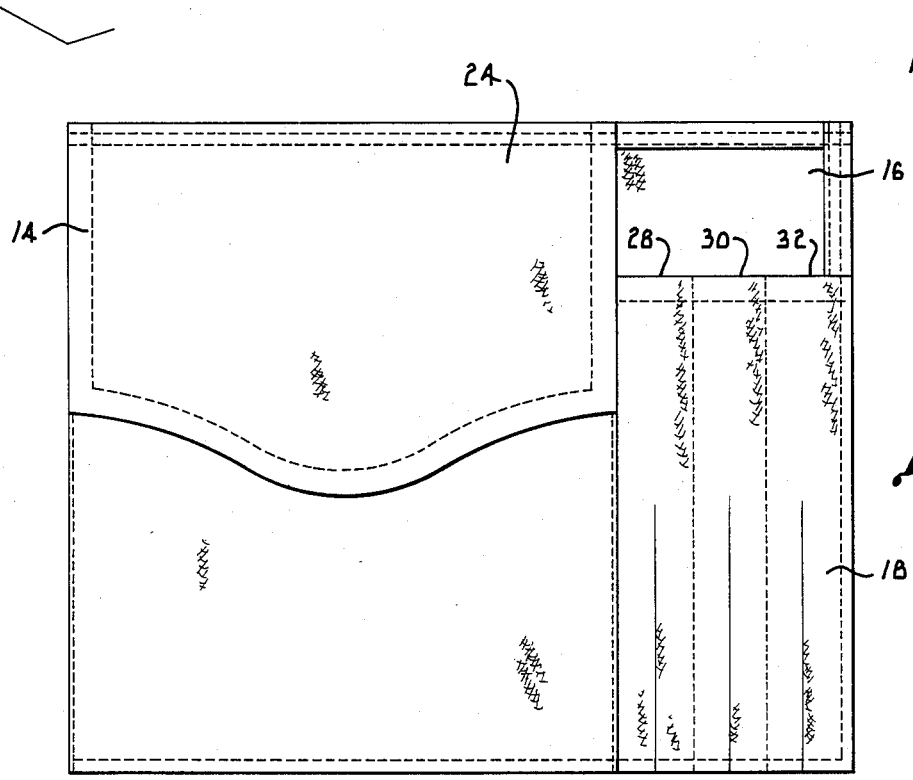
FIG. 2 is a front elevational view of the accessory holder.

Exterior front wall 18 is preferably sewn to back wall 16 as shown in FIGS. 1 and 2 in order to form large pocket 26 and three smaller elongated pockets 28, 30 and 32. Large pocket 26 includes a pair of spaced-apart gussets 34, 36 mounting exterior front wall 18 to back wall 16 and magnetic sheet 12 so that pocket 26 is expandable. Interior front wall 20 is sewn to back wall 16 within large pocket 26 in order to form a small interior pocket 38.

Conventional elastic band 22 is sewn to back wall 16 as shown in FIG. 1 to form six loops of which three are located within large pocket 26. The other three loops are respectively located adjacent the top of small pockets 28, 30 and 32.

Pocket flap 24 is designed to close the top of large pocket 26 and can be releasably held in a closed relationship therewith by means of hook-and-eye fastener. Fastener 40 is commonly known as VELCRO and includes hook portion 42 centrally located on the inside surface of flap 24 and eye portion 44, matingly located on the outside surface of exterior front wall 18.

Fabric material 14 is sewn to flexible magnetic sheet 12 as shown in FIG. 2 in order to form completed accessory holder 10.

The preferred embodiment of accessory holder 10 as illustrated in FIGS. 1 and 2 is designed for convenient use on the interior of a school locker door or refrigerator door which are typically composed of ferromagnetic sheet metal. Even though a particular ferromagnetic surface may not be perflectly flat, flexible sheet 12 readily conforms to the surface and thereby closely and firmly holds holder 10 thereto.

In the preferred embodiment of FIGS. 1 and 2, large pocket 28 is ideally suited for holding note pads, tissues or the like. Small pockets 30 are designed to hold pens, pencils or the like which are firmly held therein by the loops of elastic band 22. Additionally, the three loops of elastic band 22 extending within large pocket 28 provide additional means for retaining pens or pencils within holder 10. Interior pocket 32 is designed for holding small objects such as coins which are easily removed therefrom. Pocket flap 34 releasably closes large pocket 28 to securely retain accessories therein.

Those skilled in the art will appreciate that the present invention contemplates nearly unlimited variations in specific arrangement and configuration of the preferred embodiment herein described. For example, any number, size, and shape of pockets may be provided as part of the present invention. Additionally, the size of the accessory holder itself may be considerably varied by using larger or smaller flexible magnetic sheets 12 as desired for a particular application. Furthermore, the fabric material may be glued rather than sewn to sheet 12. Finally, back wall 16 is provided as an esthetically pleasing covering over the magnetic sheet but may be eliminated in which case the front surface of the magnetic sheet serves as the back wall.

Having thus described the preferred embodiment of the invention, what is claimed as new and desired to be secured by Letters Patent is:

1. An accessory holder for holding accessory articles and for magnetically and releasably coupling with a ferromagnetic surface, said holder comprising:

flexible magnetic material having opposed front and back faces for magnetically and releasably coupling with the ferromagnetic surface with said back face adjacent thereto and for flexibly conforming to variations of the ferromagnetic surface in order to maximize the effective area of adjacency between said back face and the ferromagnetic surface relative to the total surface area of said back face;

fabric material including a front wall; and means coupling said fabric material to said magnetic material for forming said fabric material into a desired configuration for defining an article-receiving pocket between said front face and said front wall, said back face of said magnetic material presenting a surface area at least as great as the surface area of said front wall for providing sufficient surface area to ensure secure coupling with the ferromagnetic surface, and for cooperating with the ferromagnetic surface when magnetically coupled therewith for maintaining said desired configuration of said fabric material.

2. The accessory holder as set forth in claim 1, said fabric material further including a back wall coupled with said front wall for cooperatively forming said at least one pocket therebetween.

3. The accessory holder as set forth in claim 1, said flexible magnetic coupling means including a sheet of flexible non-ferrous material having permanently magnetized particles dispersed throughout.

4. The accessory holder as set forth in claim 1, said fabric material including vinyl.

5. The accessory holder as set forth in clam 1, said fabric material being sewn to said magnetic material.

* * * * *